US005950792A

United States Patent [19]

DiPaolo

[11] Patent Number: 5,950,792

[45] Date of Patent: Sep. 14, 1999

[54] APPARATUS FOR LOCKING SHOPPING CARTS TOGETHER AND METHOD OF UTILIZATION THEREOF

[76] Inventor: Anthony M. DiPaolo, 12379 Oak Hollow, St. Louis, Mo. 63141

[21] Appl. No.: 08/966,947

[22] Filed: Nov. 10, 1997

[51] Int. Cl.[6] ..... G07F 5/02

[52] U.S. Cl. ..... 194/212; 194/905

[58] Field of Search ..... 194/905, 205, 194/212

[56] References Cited

U.S. PATENT DOCUMENTS

| | | | |
|---|---|---|---|
| 2,888,835 | 6/1959 | Patzer | 194/205 |
| 4,635,782 | 1/1987 | Wieth et al. | 194/212 |
| 4,766,989 | 8/1988 | Maloeuvre et al. | 194/905 |
| 5,040,656 | 8/1991 | DiPaolo et al. | 194/212 |
| 5,220,987 | 6/1993 | DiPaolo et al. | 194/212 |
| 5,540,316 | 7/1996 | DiPaolo et al. | 194/212 |

*Primary Examiner*—Christopher P. Ellis
*Assistant Examiner*—Bryan Jaketic
*Attorney, Agent, or Firm*—Senniger, Powers, Leavitt & Roedel

[57] ABSTRACT

Apparatus for locking shopping carts together in nested series at a cart parking station comprising mechanism adapted to be mounted on the handle of a cart adapted for releasably locking therein a latch bar on a tether which is attached to the next cart in the nested series, and a method of utilization of the apparatus for encouraging cart return by customers of the establishment using carts with the apparatus. A first phase of the invention involves an arrangement of a slide thereof and a slide-biasing spring for size reduction. A second phase involves an arrangement for mounting the mechanism on the handle of a cart with the slide extending either longitudinally or transversely of the handle. A third phase involves an arrangement for utilization of the mechanism either as a check-controlled mechanism or in the stated method.

18 Claims, 12 Drawing Sheets

APPARATUS FOR LOCKING SHOPPING CARTS TOGETHER AND METHOD OF UTILIZATION THEREOF

BRIEF SUMMARY OF THE INVENTION

This invention relates to apparatus for locking shopping carts together and to a method of utilization of such apparatus, the apparatus involving improvements over the apparatus shown in the following U.S. Patents of myself and John T. Hood, each entitled Coin-Controlled Apparatus for Locking Shopping Carts Together, these patents being incorporated herein by reference:

| U.S. Pat. No. | Issue Date |
|---|---|
| 5,040,656 | August 20, 1991 |
| 5,131,517 | July 21, 1992 |
| 5,220,987 | June 22, 1993 |
| 5,540,316 | July 30, 1996 |

U.S. Pat. No. 5,540,316 is directed, in part, to an improved construction for the apparatus shown in the other three patents listed above enabling it to be made in a substantially smaller size so as to take up less room and to have a better appearance on the handle of a shopping cart and to enable savings in material and easier assembly of parts for economy of production. This invention is directed to improvement of the construction shown in said U.S. Pat. No. 5,540,316 with the object of enabling it to be made even further smaller so as to take up even less room on the handle of the shopping cart and to enable further savings in material. The invention is further directed to improved constructions with the object of reducing the number of parts, and one of which enables constructions for mounting the apparatus either in a position extending lengthwise of the handle of the shopping cart i.e., with the slide of the apparatus extending longitudinally of the handle, or transversely of the handle, i.e. with the slide extending crosswise of the handle (generally at right angles to the handle). A further phase of the invention involves a construction for apparatus for locking shopping carts together utilizing certain principles of either the apparatus shown in the above patents or the present invention and modified to provide for utilization of the apparatus in a method such as to encourage return of a cart to a cart corral, e.g. a corral on the parking lot of a supermarket or the like establishment, and lock-up of the cart by a customer, after the customer has wheeled the cart to the customer's car and taken purchased items out of the cart and placed them in the car.

In general, a first phase of the invention involves an apparatus for locking shopping carts together in nested series comprising check-controlled mechanism which is mounted on a cart and which is adapted for receiving and releasably locking therein a bar on a tether attached to the next cart in the series, the term "check" being used here in a generic context as applicable to a coin, token or an equivalent thereof. This mechanism comprises an elongate body having a top, bottom, sides and rearward and forward ends, with an elongate slideway for a slide extending therein from the rearward end thereof toward the forward end, said body being adapted for being mounted in a generally horizontal position on a shopping cart and being of two-part construction comprising a lower part having an elongate bottom wall, upwardly extending side walls, and a forward end wall, and an upper part having an elongate top, downwardly extending side walls extending on the side walls of the lower part and a forward end wall on the forward end wall of the lower part. A slide having a forward and a rearward portion is slidable in the slideway between an outer rearward position and a forward position, means being provided for limiting rearward movement of the slide and determining its rearward position. The rearward portion of the slide has a relatively deep narrow recess for holding a check e.g. a coin or token on edge therein with the check projecting up out of said check-holding recess, the latter being located outwardly of the rearward end of the body when the slide is in its rearward position for deposit of a check therein and for retrieval of a check therefrom and being located within the body when the slide is pushed inward and forward, spring means being provided biasing the slide outwardly to its said rearward position. The body has a hole at one side for insertion of a bar, means being provided for latching the slide in its said forward position and latching the inserted bar in said body, the slide being released from said forward position for return to its said rearward position by the bar upon insertion of the bar in said body. The apparatus is characterized in that the slideway has sides defined by the upwardly extending walls of the lower part and the downwardly extending walls of the upper part and a bottom in the lower part, the latter being formed with a groove in the bottom of the slideway extending lengthwise of the slideway having a rearward end adjacent the rearward end of the body and a forward end spaced from the forward end of the body, the slide having a lug extending down into said groove slidable in the groove lengthwise of the groove, and so located along the length of the slideway as to be adjacent the rearward end of the groove when the slide is in its rearward position, the slide-biasing spring means comprising a coil compression spring pocketed in the groove between the lug and the forward end of the groove and reacting from the forward end of the groove against the lug to bias the slide outwardly to its rearward position.

A second phase of the invention involves a locking mechanism comprising a body having a top, bottom, sides and rearward and forward ends, with an elongate slideway for a slide extending therein from the rearward end thereof toward the forward end, said body being of two-part construction comprising a lower part having an elongate bottom wall, upwardly extending side walls, and a forward end wall, and an upper part having an elongate top, downwardly extending side walls extending on the side walls of the lower part and a forward end wall on the forward end wall of the lower part; a slide having a forward and a rearward portion slidable in the slideway between an outer rearward position and a forward position; means for limiting rearward movement of the slide and determining its rearward position; the rearward portion of the slide having a relatively deep narrow recess for holding a check on edge therein with the check projecting up out of said recess, the latter being located outwardly of the rearward end of the body when the slide is in its rearward position for deposit of a check therein and for retrieval of a check therefrom and being located within the body when the slide is pushed inward and forward; said mechanism characterized in that each of said upper and lower parts of the body is molded of plastic and said lower part is molded with a groove in the bottom thereof extending from the rearward end to the forward end thereof for receiving the handle of a cart on which the apparatus is to be mounted in position extending lengthwise of the handle, and wherein said lower part is also molded with a groove in the bottom thereof extending from one side to the other side thereof for receiving the handle of a cart on which the apparatus is to be mounted in position extending crosswise of the handle.

A third phase of the invention involves a locking mechanism comprising a housing for attachment to a cart; a holder having a recess therein for holding either a check for check-controlled operation of the mechanism or an item serving as a reward for a customer returning the cart to a cart corral and locking the cart so returned to the next cart in the series; said holder being carried by the housing for movement inward and outward relative to the housing between a first position wherein the recess is accessible outside the housing and a second position wherein the recess is within the housing and inaccessible; a detent mounted in the housing for movement between a position for limiting the inward movement of said holder and a retracted position allowing inward movement of the holder to its said second position; spring means biasing the holder outward to its said first position; the housing having an opening for insertion of a bar; means for latching the holder in its said second position and latching the inserted bar in said housing, the holder being released from its said second position for return to its said first position by the bar upon insertion of the bar in said housing; and a detent actuator removably associated with the holder for moving the detent to its retracted position allowing inward movement of the holder to its said second position for operation of the apparatus in a mode wherein an item serving as a reward is placed in the recess and the holder moved inward as permitted by movement of the detent to its said retracted position, said detent actuator being removable for operation of the mechanism in alternative mode of operation wherein a check is placed in the recess for moving the detent to its retracted position to permit inward movement of the holder to its said second position.

A fourth phase of the invention, relating to the handling of shopping carts by an establishment which provides shopping carts for use by its customers, involves the method of encouraging the return of the carts by customers to a cart corral after completion of shopping comprising providing carts for customer use equipped with a mechanism for locking carts together in a nested series with the carts unlocked for being wheeled away for shopping by customers, the locking mechanism on each cart being adapted to receive a bar on a tether attached to the next cart in the series and comprising a housing for attachment to a cart, said housing having an opening for insertion of a bar, a holder having a recess therein adapted to hold an item serving as a reward for a customer returning the cart to a cart corral and locking the cart so returned to the next cart in the series, said holder being carried by the housing for movement inward and outward relative to the housing between a first position wherein the recess is accessible outside the housing and a second position wherein the recess is within the housing and inaccessible, means for biasing the holder outwardly to its said first position, and means for latching the holder in its said second position and latching the inserted bar in said housing, the holder being released from its said second position for return to its said first position by the bar upon insertion of the bar in said housing; maintaining a supply of carts with the locking mechanism of each cart in said supply having its said holder latched in its said second position within said housing, one or more of the carts in said supply having an item in the recess in the holder of the locking mechanism thereof serving as a reward for the customer using the cart, the holder being released for movement to its said first position presenting the reward to the customer upon return of the cart by the customer to a cart corral and locking of the cart to the next cart of a series in the corral.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
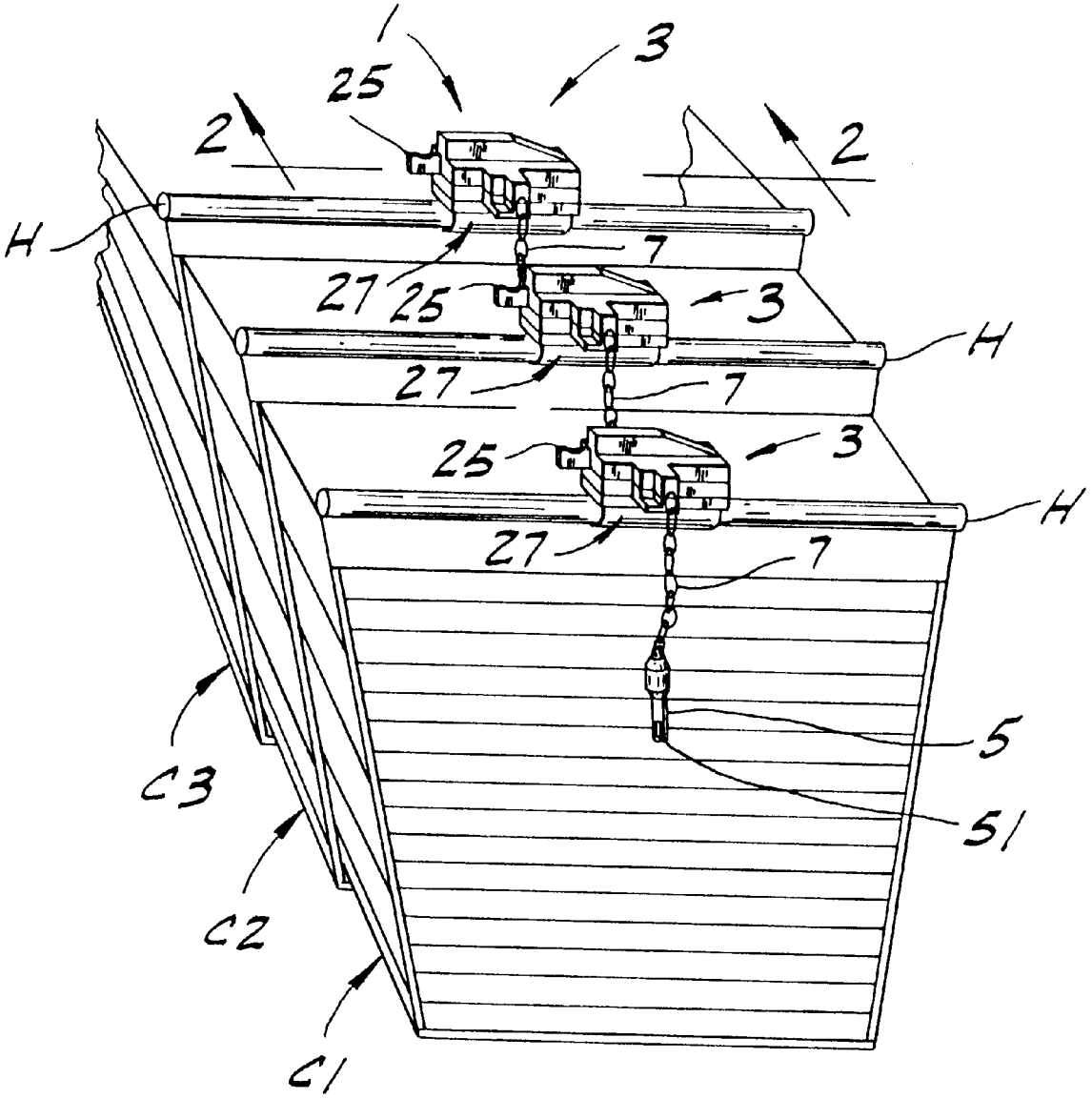
FIG. 1 is a generally perspective view showing a series of nested shopping carts locked together by apparatus of this invention, the cart wheels being omitted.

Referring first to FIG. 1 of the drawings, there is shown a series of shopping carts disposed in nested relation as at a cart parking station (a "corral") in the parking lot of a supermarket. Three such carts are shown, designated C1, C2 and C3, C1 being the end cart of the series nested in C2, and C2 being nested in C3. The handle of each cart is designated H; the cart wheels are omitted. At 1 is generally indicated apparatus of this invention for locking the carts together in the nested series, this apparatus comprising improved check-controlled mechanism designated in its entirety by the reference numeral 3 mounted on each cart, more particularly on the handle of the cart, each mechanism being adapted for receiving and releasably locking therein (under control of a check) a latch bar 5 on a tether 7, preferably a chain, which is attached to the next cart (more particularly attached to the mechanism 3 on the next cart in the series). As illustrated in FIG. 1, similar to FIG. 1 of our aforesaid U.S. patents, cart C1 is locked to cart C2 by the latch bar 5 on the chain 7 extending from the mechanism 3 on cart C2 and cart C2 is locked to cart C3 by the latch bar 5 on the chain 7 extending from the mechanism 3 on cart C3. The chain 7 which is secured to the mechanism 3 on cart C1 is shown as hanging loose, awaiting insertion of the latch bar 5 on that chain in the mechanism 3 on the next cart which is wheeled up to be nested in cart C1. The size and appearance of the improved coin mechanism 3 of this invention as shown in FIG. 1 herein are to be contrasted with the size and appearance of the coin mechanism 3 of our aforesaid prior patents and particularly U.S. Pat. No. 5,540,316 as shown in FIG. 1 of each of the latter.

Each check-controlled mechanism 3 of this invention comprises an elongate housing or body generally designated 9 having a top 11, bottom 13, sides 15 and 17 and ends 19 and 21, end 19 being referred to as the rearward end and end 21 being referred to as the forward end. The body is made to have an elongate opening 23 therein extending from its rearward end 19, where it is open, toward but terminating short of its forward end 21, where it is closed. This opening 23 constitutes a slideway for a slide 25 which extends slidably therein from the rearward end 19 of the body toward the forward end 21. The body 9 is adapted for being mounted in a generally horizontal position on a shopping cart, more particularly in such position above the handle H of the cart extending lengthwise of the handle by having mounting means such as generally indicated at 27 on the bottom thereof to be more particularly described.

The elongate body 9 is of two-part construction comprising a lower part 29 (see FIGS. 10–13) generally of channel shape in cross section having an elongate bottom wall or web 31 (the bottom of which is the bottom 13 of the body), upwardly extending side walls 33 and 35 and a forward end wall 37, and an upper part 39 (see FIGS. 6–9) generally of inverted channel shape in cross section having an elongate top 41, downwardly extending side walls 43 and 45 and a forward end wall 47. The side and end walls have a height one-half the full body height. The two parts are assembled with the downwardly extending side walls of the upper part extending on the upwardly extending side walls of the lower part, and with the forward end wall of the upper part mating with the forward end wall of the lower part, the two parts being secured together as by screws as indicated at 49 in FIG. 5A threaded up in tapped holes 50 in the parts. Each of parts 29 and 39 is preferably molded of plastic.

Figure 12:
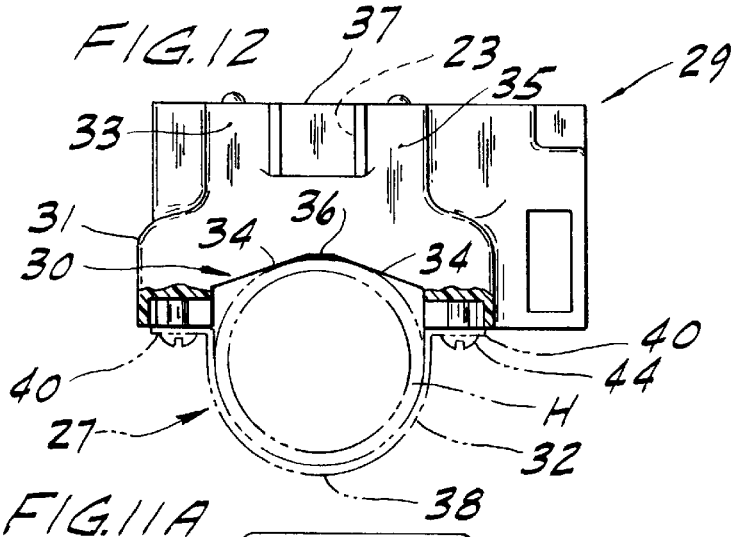
FIG. 12 is a view of the lower part from its left end, showing in phantom a clamp for clamping the mechanism on the handle of a cart.
Figure 11A:
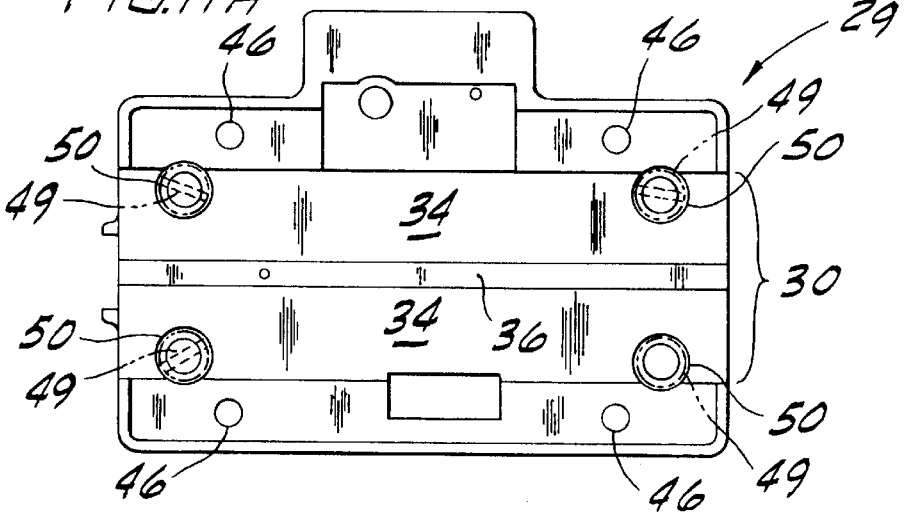
FIG. 11A is a bottom plan of the lower part of the body.

The aforesaid mounting means 27 for mounting the body 9 in generally horizontal position above the handle H of a cart extending lengthwise of the handle, i.e. with the slide 25 extending lengthwise of the handle, is shown as involving the molding of the plastic lower part 29 of the body with its bottom wall or web 31 wider than the distance between the outside surfaces of the side walls 33, 35, and with a groove 30 in the bottom 31 extending from the rearward end to the forward end of said lower part for receiving the handle H of a cart on which the apparatus is to be mounted in position extending lengthwise of the handle on top of the handle and a clamp 32 (see FIG. 12) which extends lengthwise of the handle on the bottom of the handle fastened to said lower part. The groove has a top formation comprising surfaces indicated at 34 angled outward and downward from a central peak 36 for fitting on a cart handle (cart handles generally being of elongate cylindrical form), with the surfaces 34 longitudinally and tangentially engaging the handle. The clamp 32 is preferably formed from a sheet metal blank as a handle-receiving channel 38 of part-circular cross section with flanges 40 extending laterally outwardly from the side edges of the channel (the upper edges of the channel as applied to the handle on the bottom of the handle). The flanges have holes adjacent their ends receiving clamp screws 44 threaded in tapped holes 46 extending upward in the lower part of the body on opposite sides of the downwardly opening groove 30 in the lower part for clamping the apparatus in selected position on the handle with the apparatus extending lengthwise of the handle as shown in FIGS. 1 and 12.

Figure 16:
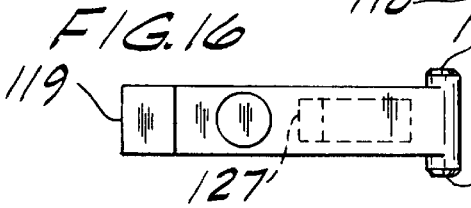
FIG. 16 is a top plan of a detent of the mechanism.
Figure 17:
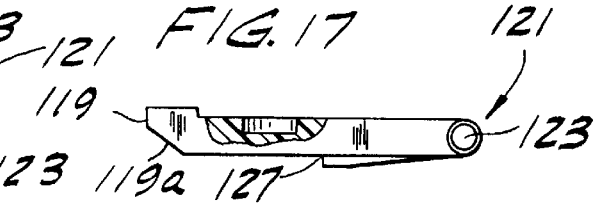
FIG. 17 is a side elevation of the detent partly broken away and shown in section.
Figure 18:
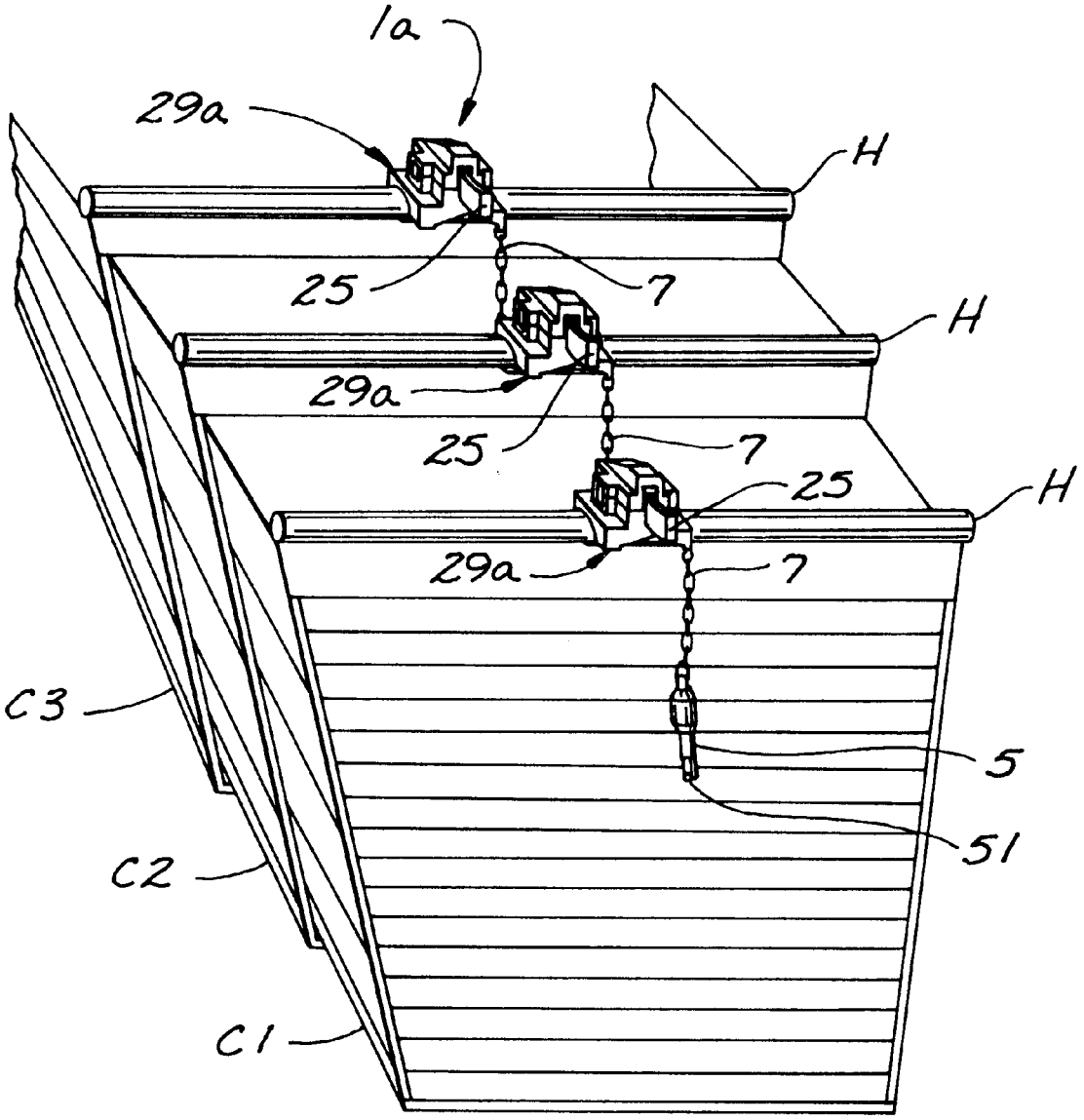
FIG. 18 is a view similar to FIG. 1 showing a modification of the apparatus of FIGS. 1–17 for being mounted on the handle of a cart either longitudinally or transversely of the handle, and showing the apparatus on each cart extending transversely of the handle.

The latch bar 5 is an elongate bar which may have the cross section illustrated in FIG. 16 in the aforesaid U.S. Pat. No. 5,540,316 and having a rectangular hole 51 therein (see FIG. 1) adjacent one end thereof, which may be referred to as its inner end, extending through the bar from one broad side thereof to the other. The body 9 is formed in its side 15 (constituted by walls 33 and 43 of parts 29 and 39), which is the side of the body which faces forward relative to the cart as the mechanism 3 is mounted on the handle of the cart, with a hole 53 for insertion of the latch bar. This hole is formed by a slot 55 in the upwardly extending side wall 33 of the lower part 29 of the body and an aligned slot 57 in the downwardly extending side wall 43 of the upper part 39 of the body, each slot forming half the hole. The body is also formed with a latch housing generally designated 59 on the side opposite the hole 53 extending laterally outwardly therefrom with a recess 61 in this housing and a second hole 63 generally transversely aligned with the hole 53 extending between the slideway 23 and the recess 61 in said latch housing 59. The latter comprises a lower part 65 on the outside of the lower part 29 of the body and an upper part 67 on the outside of the upper part 39 of the body. The lower part 65 has a bottom 69, and upwardly extending side walls 71 and 73 and an end wall 75, and the upper part 67 has a top 77, downwardly extending side walls 79 and 81 and an end wall 83, these walls all having a height one-half the body height and registering to form the housing 59 with the recess 61 therein. The hole 63 is narrower than the recess 61 and is located somewhat off center at the end of the recess toward the slideway 23, defining a shoulder 85 at the end of the recess toward the slideway 23. It is formed by a slot 87 in the upwardly extending side wall 35 of the lower part 29 of the body 9 and an aligned slot 89 in the downwardly extending side wall 45 of the upper part 39 of the body. End walls 75 and 83 meet to form a closed outer end for the housing 59. Provision is made for attaching the chain 7 to the body 9 alongside latch housing 59 as indicated at 60.

The top 41 of the upper part of the body 9 has a top formation 91, constituting a detent housing, having an elongate detent-receiving recess 93 therein. This recess is narrower than the distance D (see FIG. 7) between the inside faces of the side walls 43 and 45 of the upper part 39 of the body 9 and extends forward lengthwise of the body from adjacent the rearward end 19 of the body, being centered with respect to the side walls 43 and 45 of the upper part 39 of the body 9 and opening downward as indicated at 95 in FIG. 6 to the space 97 between the side walls 43 and 45 of the upper part 39. With the recess 93 narrower than the distance D and centered between the inside faces of the side walls 43 and 45, the upper part 39 of the body 9 has downwardly facing shoulders 99 on the inside of and at the top of the side walls 43 and 45 thereof. These shoulders have downwardly opening pin-receiving recesses 101 adjacent the holes 53 and 63.

The detent housing 91 is preferably configured to have a rearward horizontal top portion 91*a* extending from the rearward end of the body 9 for about one-fourth the length of the body and a forward inclined portion 91*b* slanting down toward the forward end of the body. Shoulders 99 extend generally the full length of the body.

Figure 2:
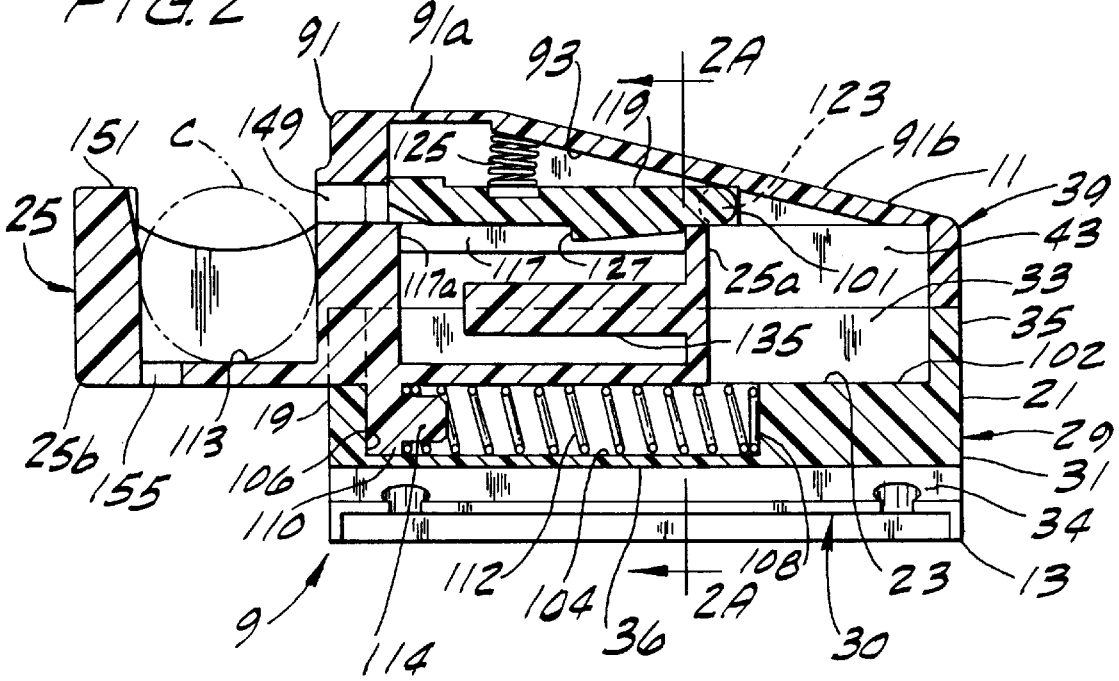
FIG. 2 is vertical longitudinal section of a check-controlled mechanism of the apparatus, generally on line 2—2 of FIG. 1, showing the slide of the mechanism in a rearward position (its outer or retracted position) with respect to the body of the mechanism in which it is slidable, with a check shown in phantom in the slide.
Figure 3:
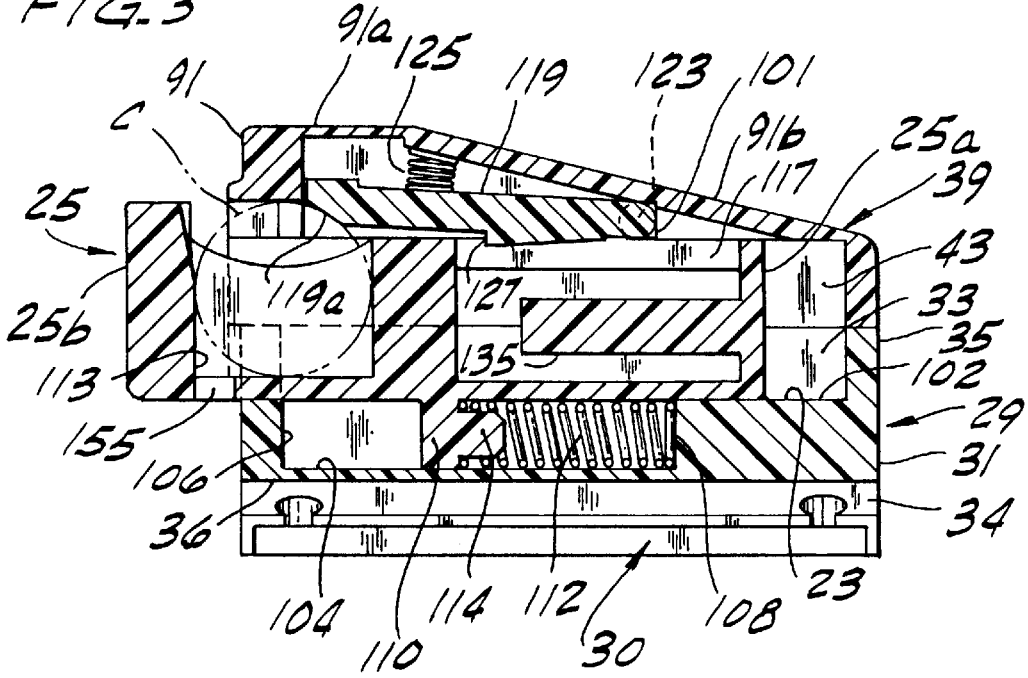
FIG. 3 is a view similar to FIG. 2 showing the coin slide in an intermediate position.
Figure 2A:
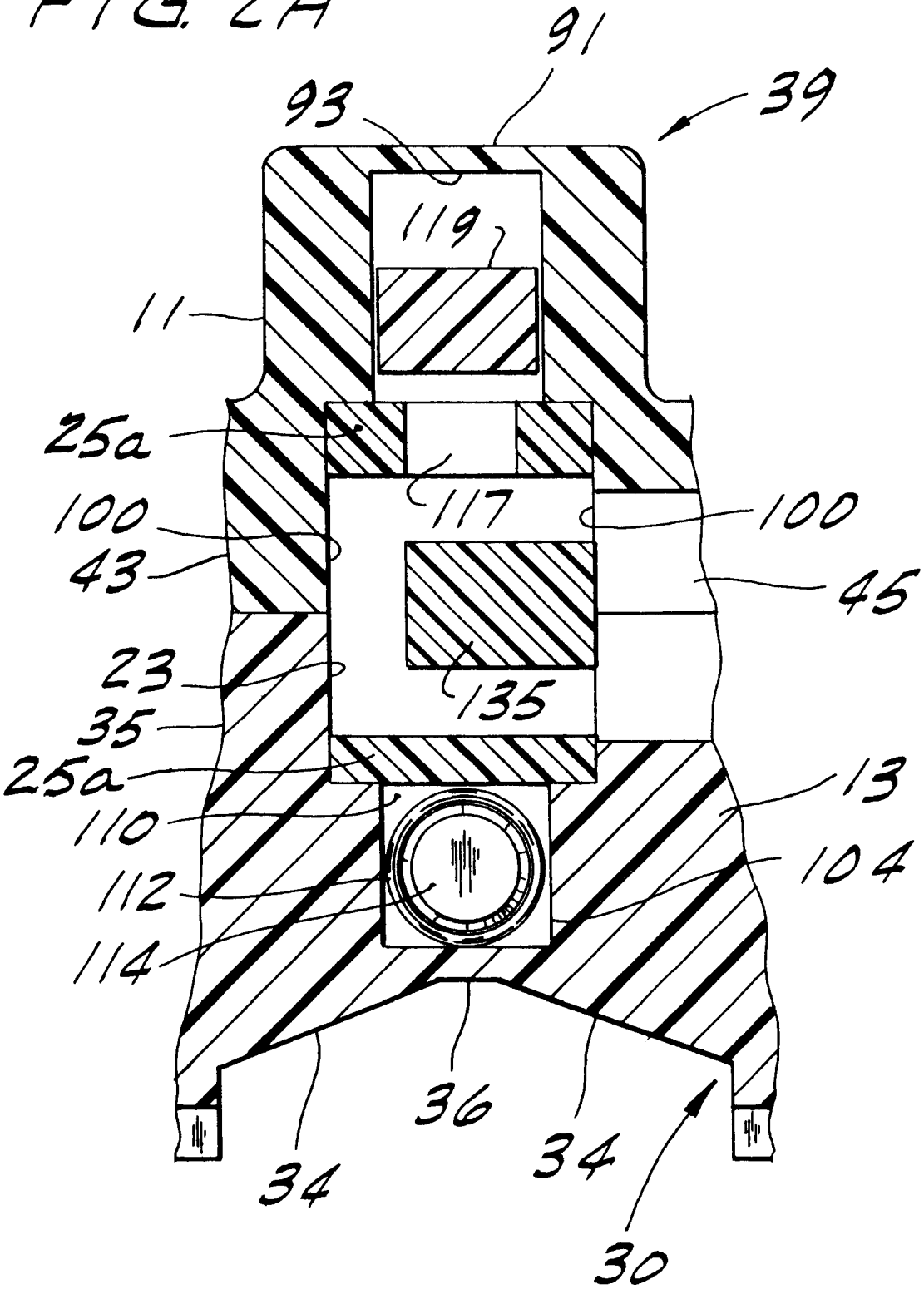
FIG. 2A is a vertical transverse section generally on line 2A—2A of FIG. 2 on a larger scale than FIG. 2.
Figure 4:
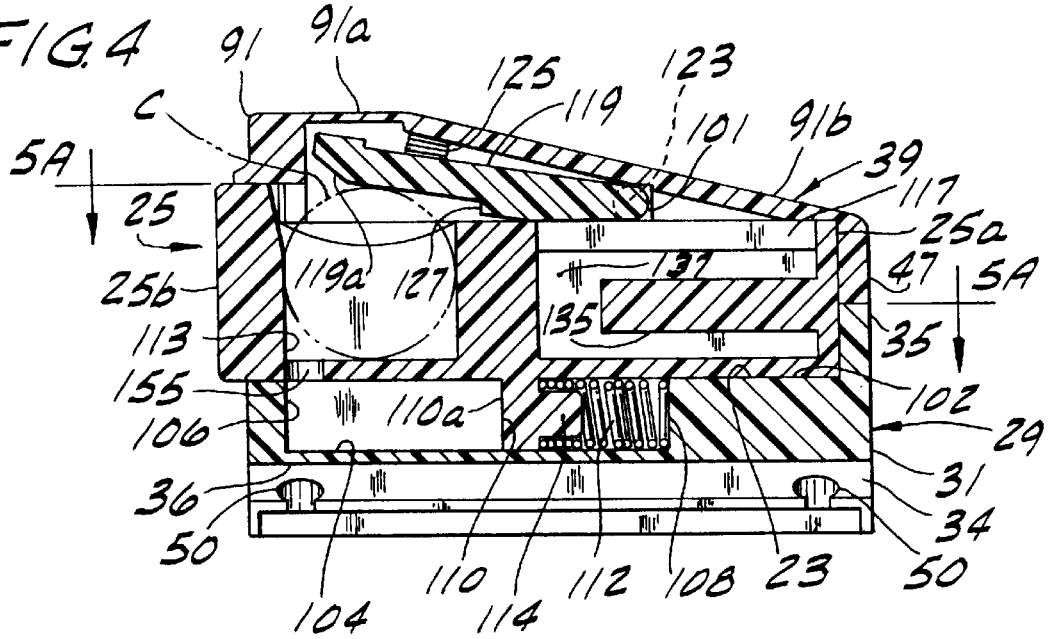
FIG. 4 is a view similar to FIGS. 2 and 3 showing the slide in its forward (inner) position.
Figure 5A:
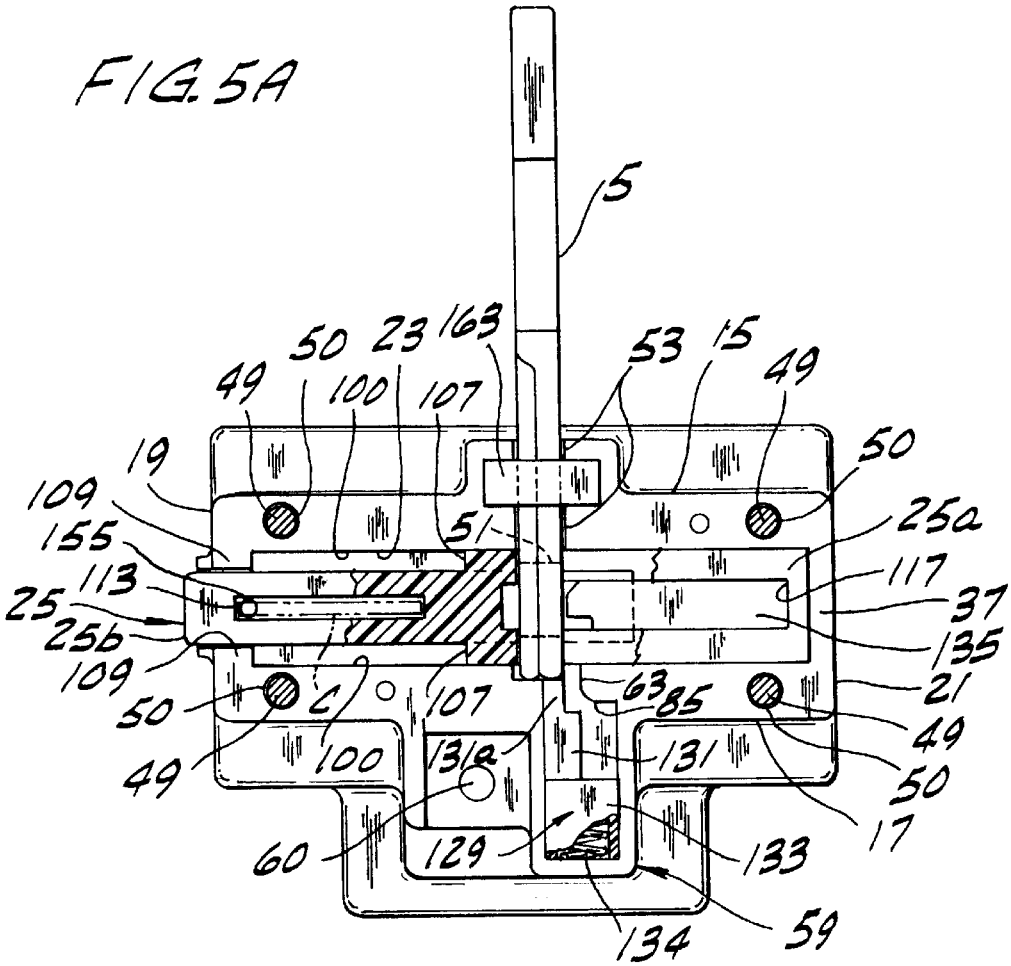
FIG. 5A is a horizontal longitudinal section generally on line 5A—5A of FIG. 4 showing the latch bar of an apparatus in position extending across the slideway in the body of the mechanism just before it is pushed out by the slide latch of the apparatus, the slide latch being shown in its retracted position.
Figure 5B:
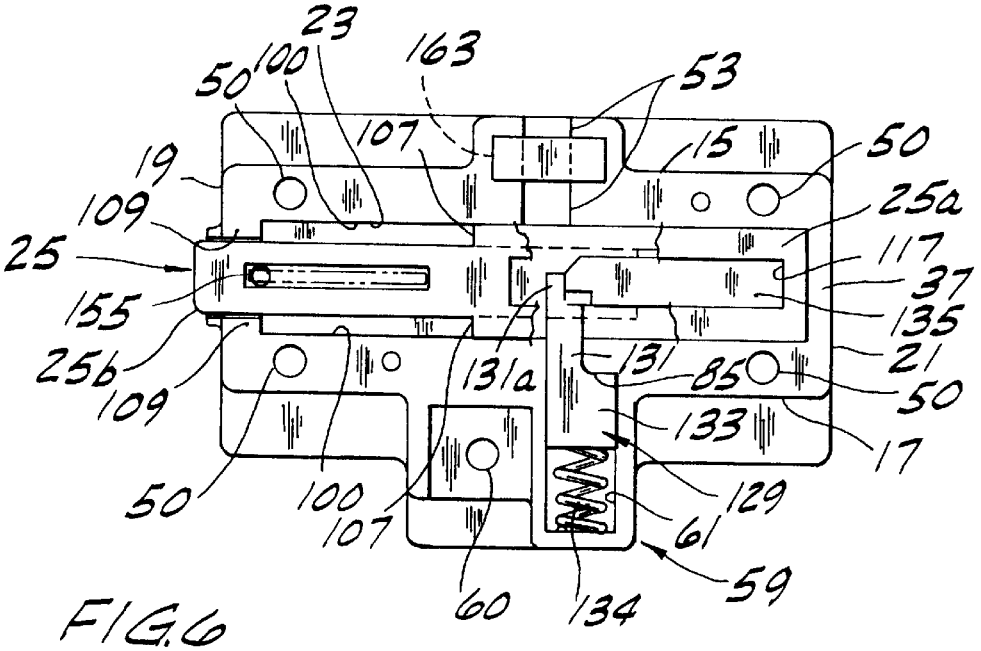
FIG. 5B is a view similar to FIG. 5A showing the slide latch in its extended position, after having pushed out the latch bar.
Figure 6:
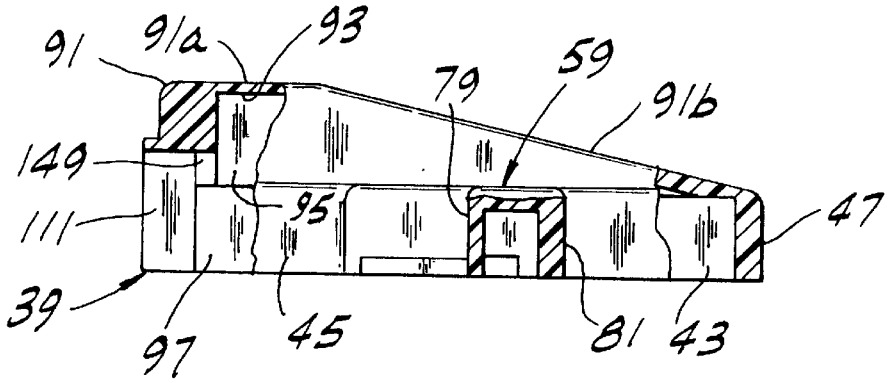
FIG. 6 is a view in elevation of one side of the upper part of the body of the mechanism, with parts broken away and shown in section.
Figure 7:
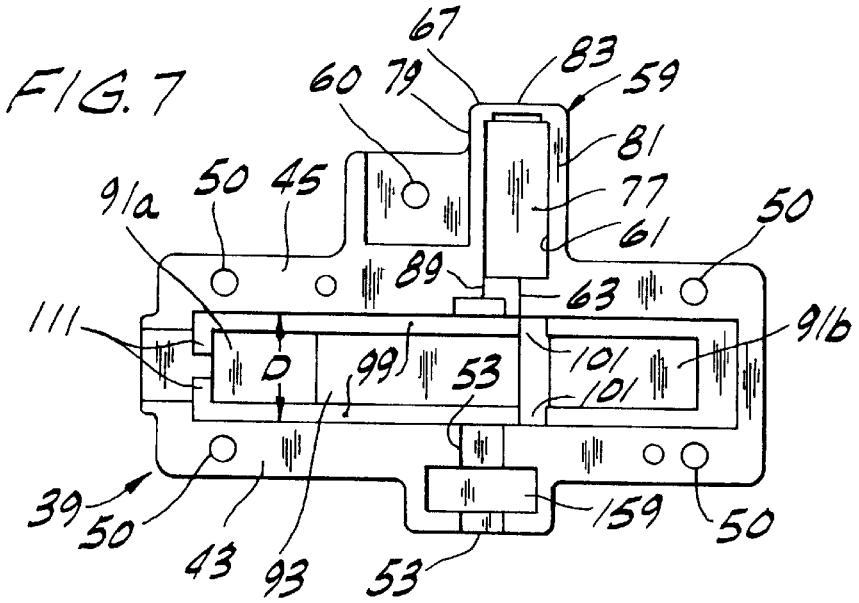
FIG. 7 is a bottom plan of the upper part.
Figure 7A:
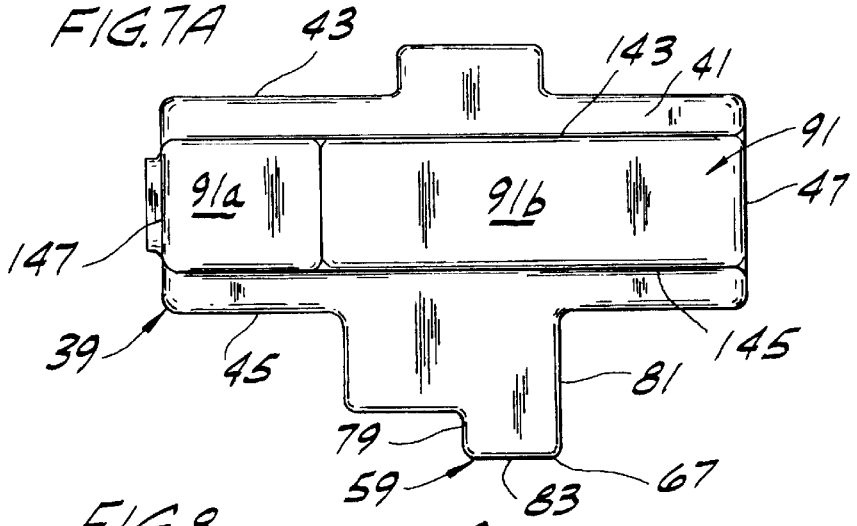
FIG. 7A is a top plan of the upper part.
Figure 8:
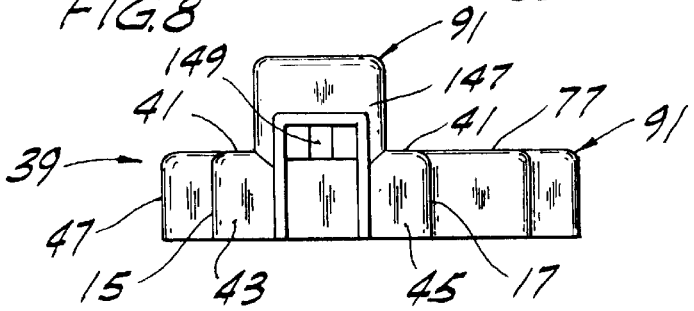
FIG. 8 is a view of the upper part from its left end.
Figure 9:
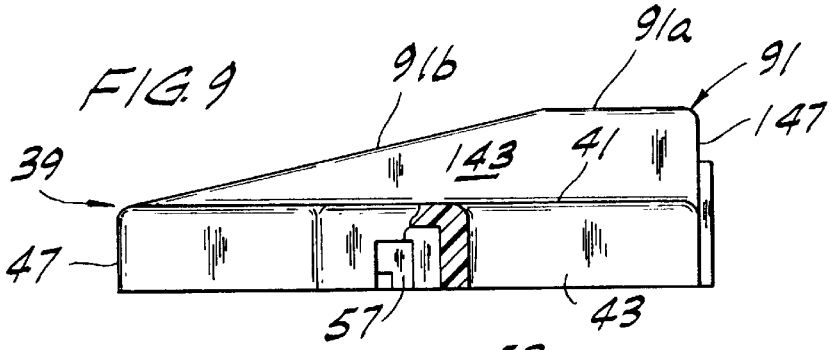
FIG. 9 is a view in elevation of the other side of the upper part, partly broken away and shown in section.
Figure 10:
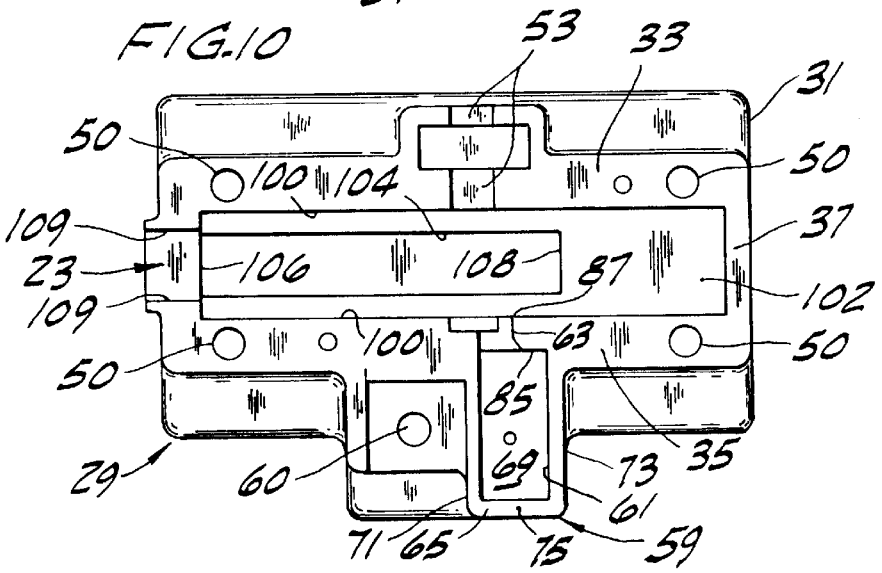
FIG. 10 is a top plan of the lower part of the body.
Figure 11:
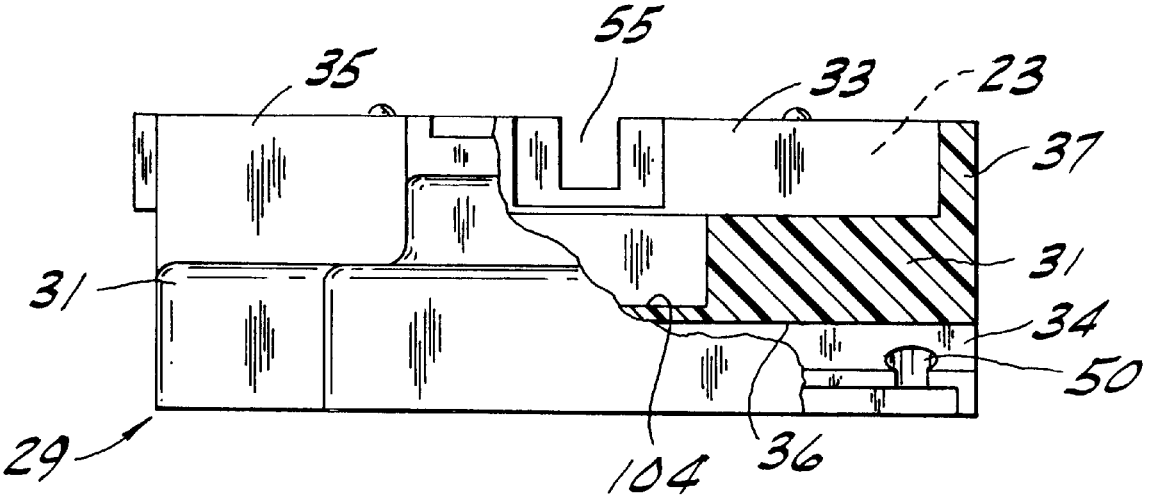
FIG. 11 is a view in elevation of one side of the lower part, with parts broken away and shown in section.
Figure 13:
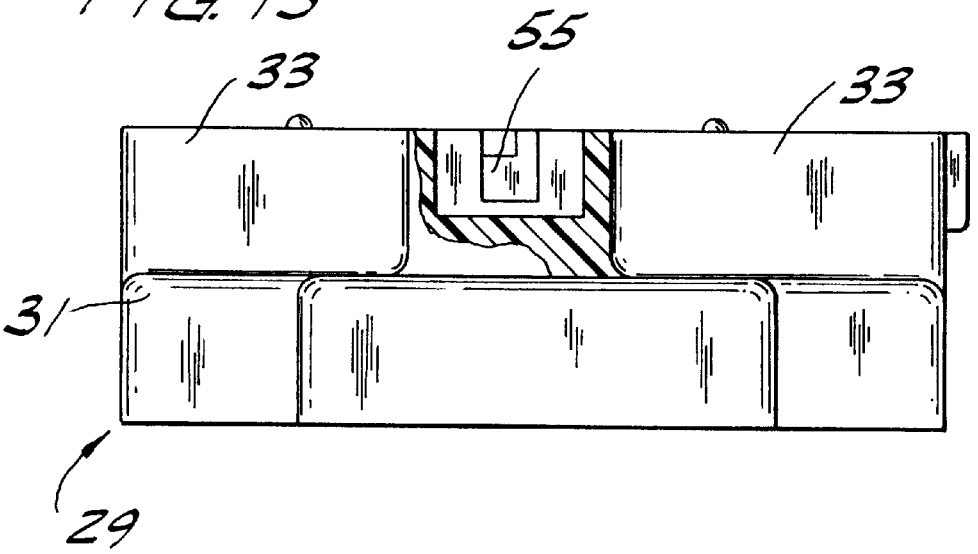
FIG. 13 is a view in elevation of the other side of the lower part, partly broken away and shown in section.

The slideway 23 has sides each designated 100 defined by the upwardly extending walls 33, 35 of the lower part 29 of the body 9 and the downwardly extending walls 43, 45 of the upper part 39 of the body, and a bottom 102 in the lower part. The lower part is formed with a groove 104 in the bottom 102 of the slideway extending lengthwise of the slideway having a rearward end 106 adjacent the rearward end of the body and a forward end 108 spaced from the forward end of the body. The slide 25 has a lug 110 extending down in the groove 104 slidable in the groove lengthwise of the groove and so located along the length of the slide as to be adjacent the rearward end of the groove when the slide is in its rearward position (see FIG. 2). The slide, which has a forward (inner) portion indicated at 25*a* and a rearward (outer) portion 25*b* ("forward" being in reference to the direction in which the slide is pushed in, and "rearward" being the reverse) is slidable in the guideway between the outer rearward position in which it is shown in FIG. 2 and the inner forward position in which it is shown in FIG. 4. It is biased to slide rearward (outwardly) to its rearward position by a coil compression spring 112 pocketed in the groove 104 between the lug 110 and the forward end 108 of the groove reacting from the forward end of the groove against the lug, the latter having a rearwardly directed centering pin 114 thereon for centering the spring. The rearward and forward portions 25*a* and 25*b* of the slide are each generally rectangular in transverse cross section with the rearward portion of reduced width relative to the forward portion thereby forming rearwardly facing shoulders 107 at opposite sides of the slide. These shoulders act in conjunction with flanges such as indicated at 109 extending laterally inwardly at the rearward ends of the side walls of the lower part 29 and flanges such as indicated at 111 extending laterally inwardly at the rearward end of the upper part as means for limiting the rearward movement of the slide and determining its stated rearward position. Also, the rear face 110*a* of the lug, which is coplanar with shoulders 107, is engageable with the rearward end 106 of the groove for this purpose (see FIG. 2). The rearward portion 25*b* of the slide 25 has a relatively deep narrow recess or pocket 113 for holding a check C, which may be a U.S. quarter, a token having a generally the same diameter and thickness as a quarter, or the like, on edge therein with the check projecting up out of the recess as appears in FIGS. 2–4. The recess 113 is located outwardly of the rearward end of the body 9 when the slide is in its rearward position of FIG. 2 for deposit or insertion of a check in the recess and for retrieval of a check from the recess, and is located within the body when the slide is pushed inward and forward to the forward position in which it is shown in FIGS. 4, 5A and 5B.

The slide 25 has an elongate slot 115 extending lengthwise thereof and extending therethrough from one side to the other in the forward (inner) portion 25*a* thereof, and an elongate slot 117 in the top thereof extending lengthwise from a point forward of and adjacent the rearward end of the forward portion 25*a* to a point adjacent the forward end of said forward portion. A detent 119 acts in conjunction with the slot 117 as means for limiting the inward movement of the slide in the absence of a check in the check-holding recess but allows inward movement of the slide to the stated forward position as long as a check is placed in the recess 113. This detent 119 has at one end thereof constituting its forward end pin means generally designated 121, the detent preferably being molded of plastic with the pin means formed integrally therewith as pins 123 extending laterally outwardly of the detent at its forward end. The pins 123 are seated in the pin-receiving recesses 101 in the shoulders 99 of the upper part 39 of the body 9, the detent 119 thereby being pivotally mounted for swinging movement in a generally vertical plane about the axis of the pins between the lowered position in which it appears in FIG. 2 and the raised position in which it appears in FIG. 4. The detent is slightly narrower than the width of the detent recess 93 and is swingable up and down in this recess. It is biased to swing downwardly to its lowered position by a spring 125 interposed between the top portion of the detent housing 91 and the top of the detent, its lowered position being determined by the engagement of the detent adjacent its rearward end with the top of the slide, as appears in FIG. 2. The pins 123 are retained (held up) in the recesses 101 by the slide 25. The detent 119 is made with a rearwardly facing step 127 on its bottom between its rearward and forward ends constituting a stop extending down into the slot 117 in the top of the slide when the detent is in its lowered position for engagement with the rearward end 117*a* of this slot when the slide is pushed in without a check in the check-receiving recess 113 to limit the inward movement of the slide, preventing it from being pushed all the way in to its FIG. 4 forward position. Thus, the rearward end 117*a* of the slot 117 constitutes stop-engaging means engageable by the stop 127.

Figure 14:
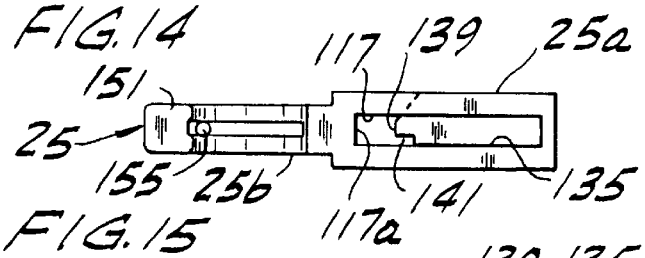
FIG. 14 is a top plan of the slide per se.
Figure 15:
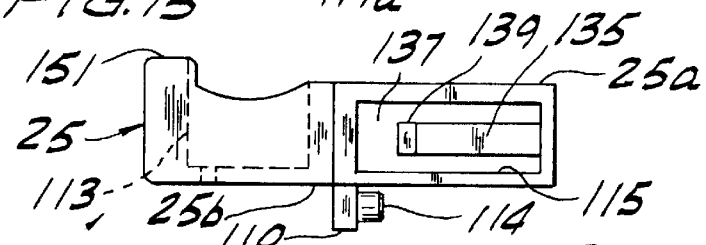
FIG. 15 is a view in elevation of one side of the slide.

At 129 is indicated a latch for latching the slide 25 in its said forward position to hold a check, e.g. a coin, in the recess against retrieval as will appear. This latch is slidable in the recess 61 in the latch housing 59 (the side housing on the body 9) and in the hole 53, being of such shape in plan as to have a stem 131 slidable in the hole 63 and a head 133 slidable in the recess 61, between a laterally retracted position clear of the slideway 23 wherein the stem 131 is back in the hole 63 (see FIG. 5A) and a slide-latching position wherein the stem 131 extends into and across the slideway 23 (see FIG. 5B). The stem 131 has a reduced width inner end 131*a* corresponding to the chamfer 131*a* of the latch shown in our aforesaid U.S. Pat. No. 5,540,316. It is biased by a coil compression spring 134 accommodated in the recess 61 between the outer end of the recess and the head 133 toward its slide-latching position. A tongue 135 for entry in the hole 51 in the latch bar 5 for locking the latch bar in the body 9 extends rearward from the forward end of the slot 115 in the slide 25 toward but terminating short of the rearward end of the slot 115 to provide a space indicated at 137 in FIG. 4 for passage of the latch bar therethrough. The tongue 135 has a tip 139 of reduced width at its rearward end defining a recess 141 at said rearward end (see FIGS. 14 and 15).

Each mechanism 3 has the respective latch bar chain 7 suitably attached securely at the other end of the chain from the latch bar 5 to the lateral housing 59 of the mechanism at 60. The mechanism is mounted on the handle of the cart with the housing 59 extending rearward with respect to the cart; thus as to the cart C1 as shown in FIG. 1, the chain 7 with the latch bar 5 thereon hangs down at the rear end of the cart in position where it is readily accessible to the user. Also as shown in FIG. 1, the slides 25 of the mechanisms on each of the three carts are in their rearward (outer) positions wherein the recesses 113 therein are accessible for dropping in a check, e.g. a coin. The latch bar 5 on the chain 7 attached to cart C2 is locked in the mechanism on cart C1, and the latch bar 5 on the chain 7 attached to cart C3 is locked in the mechanism on cart C2 as results from the tongues 135 of the coin slides 25 of these mechanisms extending through the holes 51 in the latch bars 5, thereby pinning the latch bars in the bodies 9 of the respective mechanisms.

To free cart C1 for being wheeled into the supermarket (or other establishment), the user drops a check, e.g. a coin (a U.S. quarter) into the recess 113 in the rearward (outer) portion 25*a* of the slide 25 of the mechanism 3 on cart C1 and pushes the slide in all the way to its stated forward position, i.e. the position in which it is shown in FIGS. 4 and 5A. This is enabled by reason of the upper portion of the check engaging the detent 119 adjacent its rearward end, which is beveled as indicated at 119*a*, and camming the detent upward so that the stop 127 clears the rearward end 117*a* of the slot 117 in the top of the slide. When the slide is pushed in to its forward position, the tongue 135 is withdrawn from the hole 51 in the latch bar 5 on chain 7 which extends from cart C2 thereby unlocking the latch bar and freeing it for removal from the body of the mechanism on cart C1. Under the bias of spring 133, the slide latch 129 pushes the latch bar 5 in the direction for removal from the body 9 and moves into the space 137 rearward of the rearward end of the tongue 135, thereby assuming a slide-locking position wherein it is engaged by the tip of the tongue to lock the slide 25 in its said forward (inner) position and thereby hold the check which is in the recess 113 inaccessible within the body. The user is enabled to obtain return of the check (the coin), however, by returning the cart to the parking station where it was obtained, (or another parking station) and inserting the latch bar 5 on the chain extending from the end cart of the series at the station into the hole 53 and pushing it in against the slide latch 129 and through the space 137, thereby retracting the slide latch 129 to enable the slide 25 to be pushed forward by the spring 112, and the tongue 135 to pass through the hole 51 in the latch bar 5 to lock the returned cart to the series of carts.

The detent housing 91 has side walls indicated at 143 and 145 and a rearward end wall indicated at 147. The latter extends down to the level of the shoulders 99 having a vertical slot 149 extending up from its lower edge for passage of the upper part of the check seated in the recess 113. The slide 25 has an upwardly extending knob formation 151 at its rearward end which slides into the slot 149 when the slide is pushed all the way in, access to the interior of the body thereby being blocked to avoid picking the lock when the slide is in its forward position with a check in the body. The slide is provided with a drain hole 155 to avoid collection of rainwater in the recess 113. The bar 5 is inserted through an opening in an insert such as indicated at 163 in FIG. 19 of the aforesaid U.S. Pat. No. 5,540,316.

With the spring 112 pocketed in the groove 104 acting against the lug 110 which extends down from the slide 25 substantial reduction in overall length of the apparatus is made possible. Thus, where in the prior construction shown in the aforesaid U.S. Pat. No. 5,540,316 the length of the body is a factor of the length of the slide plus the length of the spring as compressed (see FIG. 4 of said patent), with the present construction the length of the body is a factor of the length of the slide only.

Figure 19:
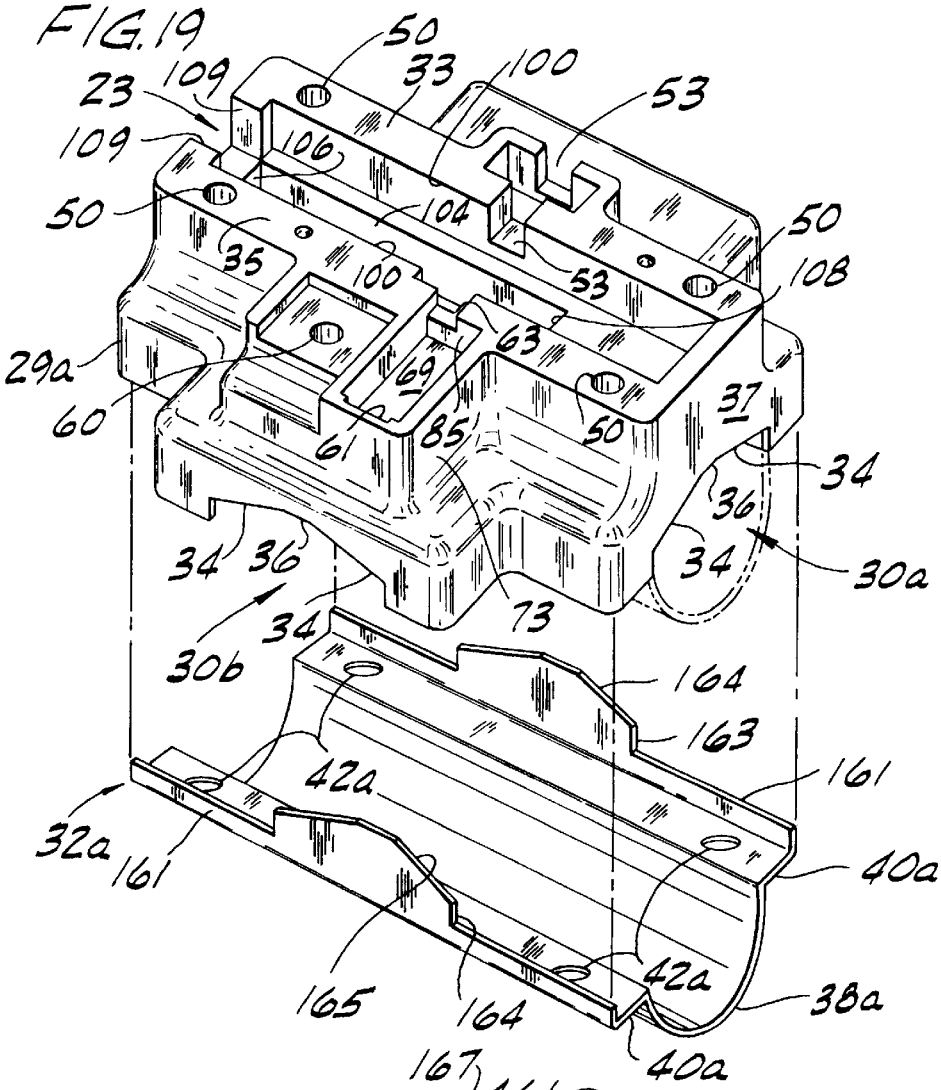
FIG. 19 is an exploded perspective showing the lower part of the dual-mounting apparatus shown in FIG. 18 as viewed from the top thereof, and showing a clamp used therewith extending longitudinally thereof.
Figure 20:
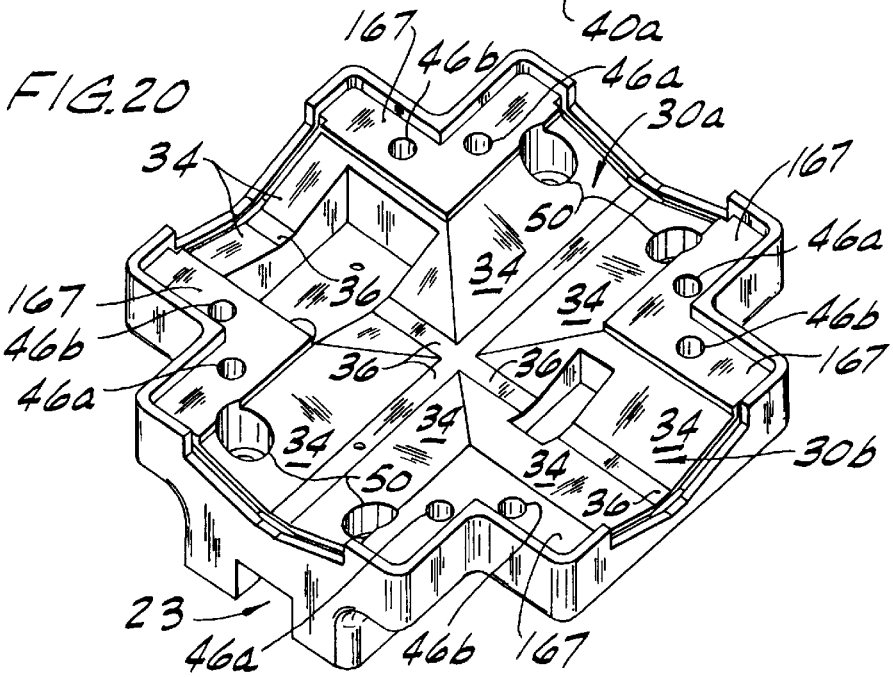
FIG. 20 is a perspective of the FIG. 18 part as viewed from the bottom thereof.
Figure 21:
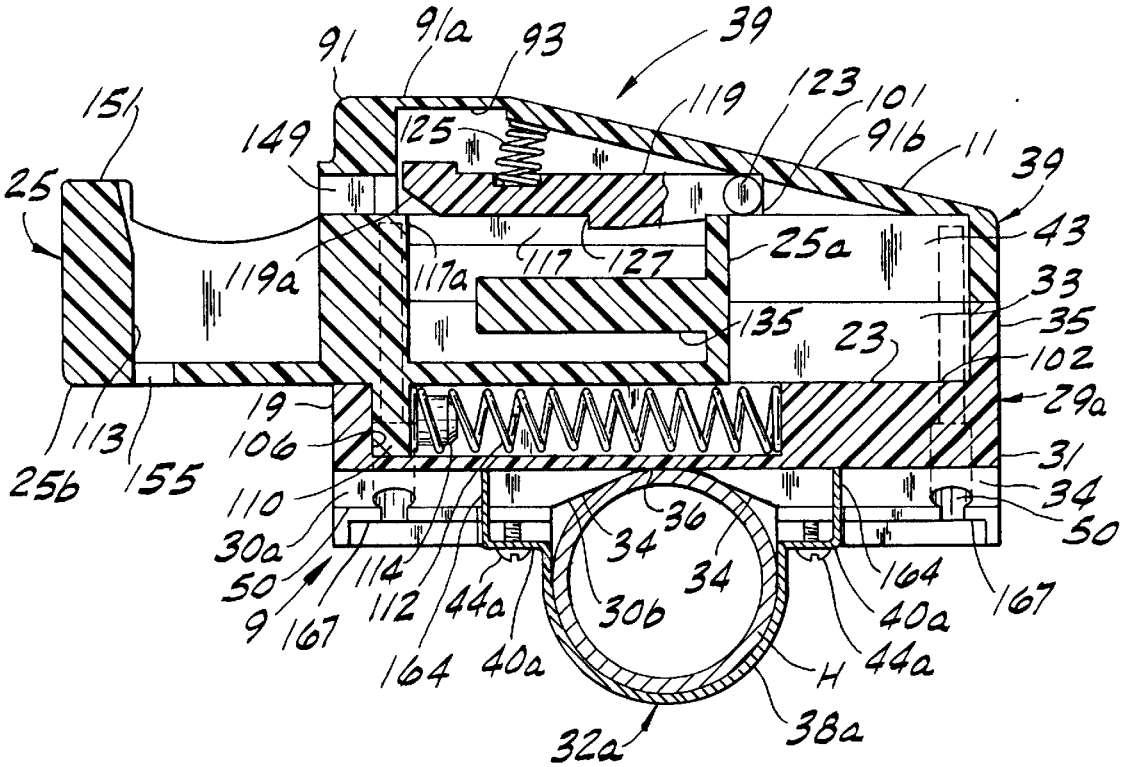
FIG. 21 is a vertical longitudinal section of the modification of FIGS. 18–20 showing the clamp as applied for transverse mounting.

FIGS. 18–21 illustrate a modification 1*a* of the above-described apparatus wherein the lower part of the body 9, designated 29*a* to distinguish it from lower part 29, is molded not only with groove 30*a* corresponding to groove 30 referred to above for mounting the apparatus on the handle of a cart with the apparatus extending lengthwise or longitudinally of the handle (i.e. with the slide of the apparatus extending lengthwise or longitudinally of the handle), but also with a groove 30*b* for mounting the apparatus on the handle of a cart with the apparatus extending transversely of the handle (i.e. with the slide 25 of the apparatus extending transversely of the handle). In this modification, the groove 30*a* (like groove 30) has a top formation comprising surfaces indicated at 34 angled downward and outward from a central peak 36, and groove 30*b* similarly has a top formation comprising surfaces indicated at 34 angled downward and outward from a central peak 36. The grooves 30*a* and 30*b* intersect centrally of the lower part. For mounting the apparatus 1*a* on the handle H of a cart with the apparatus extending lengthwise or longitudinally of the handle, the apparatus is placed on the handle with the handle received in the longitudinal groove 30*a*, and clamped in place by a clamp 32*a* similar to clamp 32 in having a handle-receiving channel 38*a* of part-circular cross section and flanges 40*a* extending laterally outwardly from the upper edges of the channel, the flanges having holes 42*a* adjacent their ends receiving clamp screws 44*a* threaded in tapped holes 46*a* extending upward in the lower part 29*a* of the body on opposite sides of the downwardly opening longitudinal groove 30*a* for clamping the apparatus in selected position on the handle with the apparatus extending lengthwise of the handle as shown in FIGS. 1 and 19. For mounting the apparatus on the handle of a cart with the apparatus extending transversely of the handle, the apparatus is placed on the handle with the handle received in the transverse groove 30*b*, and clamped in place by clamp screws 44*a* threaded in tapped holes 46*b* in the lower part 29*a*. The clamp 32*a* is modified in respect to clamp 32 in having lips on the flanges such as indicated at 161 bent to extend at right angles to the flanges, these lips being provided with tongues 164 having a width corresponding to the width of each groove 30*a*, 30*b* and having an upper edge formation indicated at 165 matching the top formation of the grooves. The lips are received in recesses such as indicated at 167 in the lower part 29*a*. When the apparatus is mounted in position extending longitudinally of the handle with the handle received in the longitudinal groove, the tongues 164 fit in and close off the transverse groove, and when the apparatus is mounted in position extending transversely of the handle with the handle received in the transverse groove, the tongues fit in and close off the longitudinal groove (see FIG. 21).

FIGS. 22 and 23–25 illustrate modifications of the above-described apparatus providing for utilization of the apparatus in a method for encouraging return of a cart by a customer to a cart corral, e.g. a corral on the parking lot of a supermarket or like establishment after the customer has wheeled the cart to the customer's car and taken purchased items out of the cart and placed them in the car, thereby reducing the scattering of the carts on the parking lot and rendering the handling of the carts by the establishment less labor-intensive.

Figure 22:
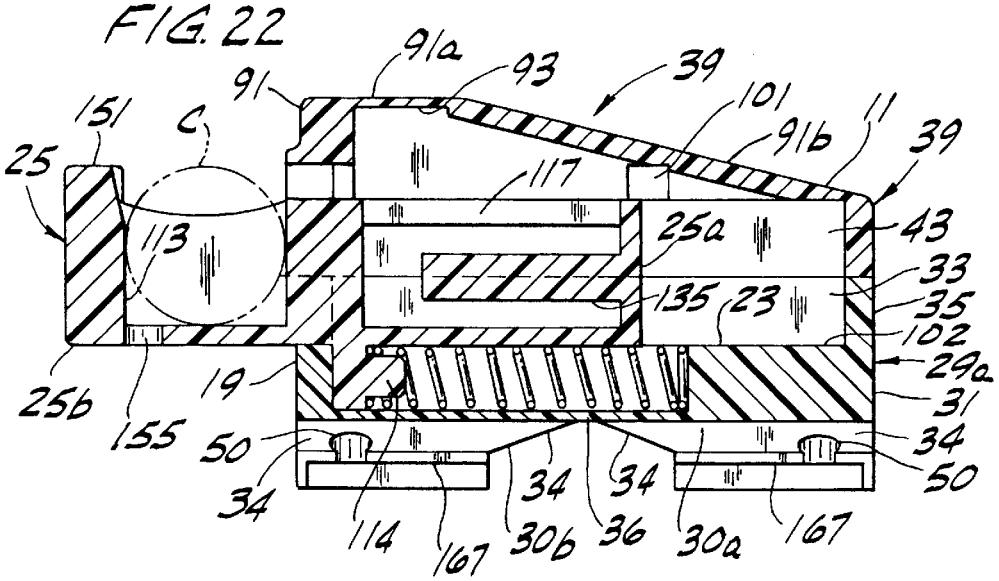
FIG. 22 is a view similar to FIG. 2 showing a modification of the apparatus for use in the aforementioned method for encouraging cart return.

As to the modification shown in FIG. 22, the apparatus as shown in FIGS. 2–17 is modified by omitting the detent 119 and the spring 125 therefor. As to the modification shown in FIGS. 23–25, the apparatus as shown in FIGS. 2–17 or in FIGS. 18–21 is retained as is, including the detent and the spring 125 therefor, and is provided with a removable detent actuator 171 adjacent the forward end of the recess 113 in the slide, more particularly a pin removably threaded in a tapped hole 173 in extending generally vertically in the slide adjacent the forward end of the recess and generally in the vertical plane of the recess.

The hole 173 extends completely through the slide from top to bottom of the slide and the pin is threaded in the hole to the point where its lower end 174 is within the hole above the bottom of the hole and its upper end 175 projects above the top of the slide for engagement with the detent, the pin having a kerf 177 at its lower end for turning the pin with a tool inserted in the hole from the lower end of the hole.

With the detent omitted in the FIG. 22 modification, a check may be inserted in the recess 113 and the slide 25 pushed in to its inner position and locked up in that position. Similarly, with the pin 171 in place in the FIGS. 23–25 modification, a reward may be inserted in the recess 113, and the slide pushed in to its inner position and locked up in that position. With the pin 171 removed, the apparatus may be utilized in the prior manner, requiring insertion of a check (e.g. a coin) in the recess 113 by a customer and pushing in of the slide to its inner position for unlocking the cart.

Figure 23:
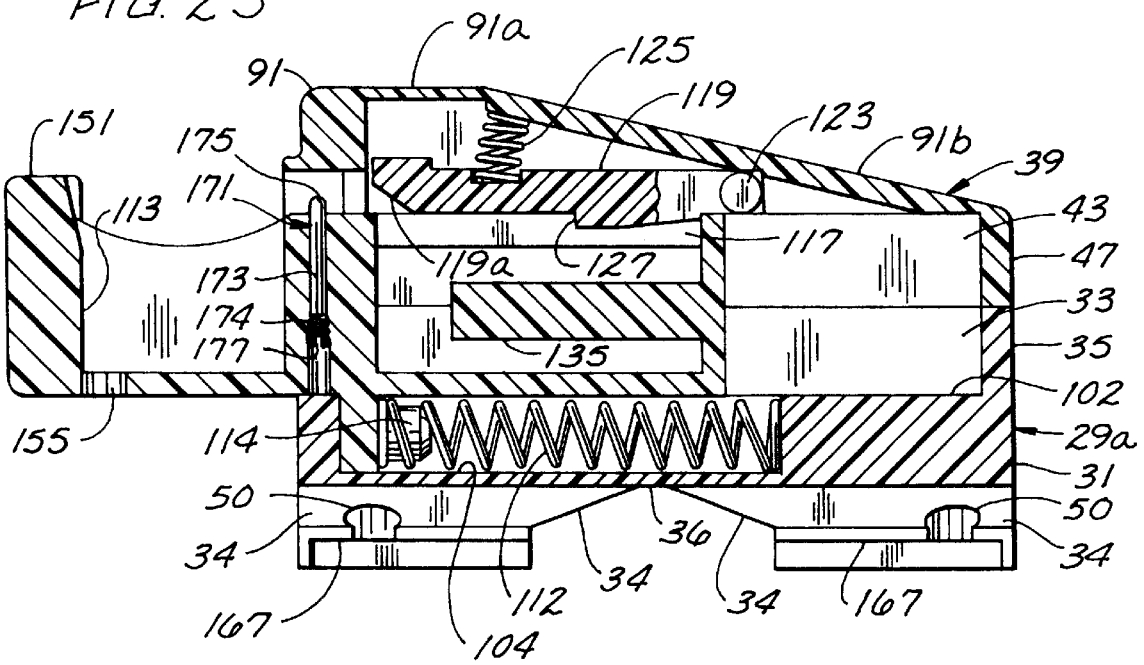
FIG. 23 is a view similar to FIG. 2 showing another modification of the apparatus for use in the aforementioned method for encouraging cart return.
Figure 24:
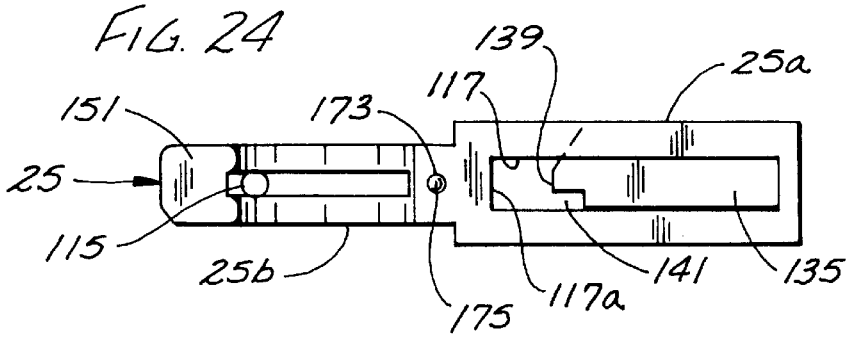
FIGS. 24 and 25 are a plan and side elevation, respectively, of the slide of the FIG. 23 modification.
Figure 25:
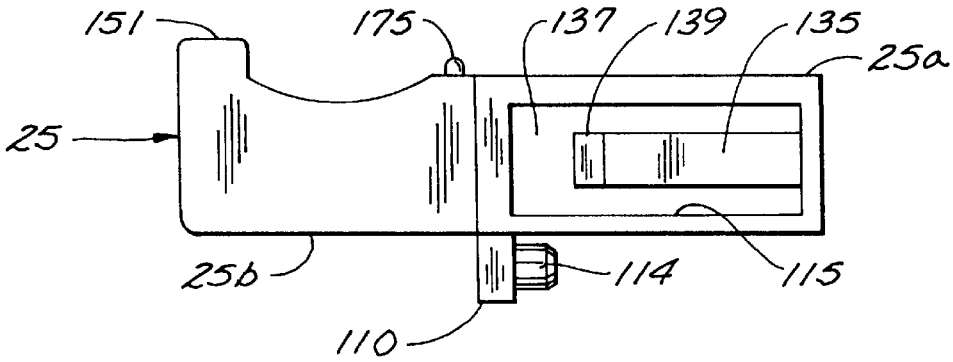

The FIG. 22 modification as shown and the FIGS. 23–25 modification with the detent actuating pin 171 in place are useful in a method of this invention of encouraging the return of carts by customers to a cart corral after completion of shopping, the method involving maintaining in the supermarket or other establishment a supply of carts for customer use with the locking mechanism of each cart in said supply having its slide (holder) 25 latched in its forward inner position within the body or housing. These carts may be of the FIG. 22 no-detent locking mechanism or the FIGS. 23–25 detented locking mechanism type with the detent-actuating pin 171 in place. One or more of these carts has an item in the recess in the slide serving as a reward for the customer using the cart, the slide being released for movement to its said rearward position presenting the reward to the customer upon return of the cart by the customer to a cart corral and locking of the cart to the next cart of a series in the corral. The reward may be, for example, a color-coded token (the color indicating the token's value), or a token labelled with a bar code which the establishment may scan to identify the reward.

It will be understood that the above described dual-groove and customer-reward modifications are also applicable to the mechanisms of the prior patents listed in the first paragraph of this specification.

In view of the above, it will be seen that the several objects of the invention are achieved and other advantageous results attained.

As various changes could be made in the above constructions and method without departing from the scope of the invention, it is intended that all matter contained in the above description or shown in the accompanying drawings shall be interpreted as illustrative and not in a limiting sense.

What is claimed is:

1. Apparatus for locking shopping carts together in nested series comprising a mechanism which is mounted on a cart and which is adapted for receiving and releasably locking therein a bar on a tether attached to the next cart in the series; said mechanism comprising:

an elongate body having a top, bottom, sides and rearward and forward ends, with an elongate slideway for a slide extending therein from the rearward end thereof toward the forward end, said body being adapted for being mounted in a generally horizontal position on a shopping cart;

said body being of two-part construction comprising a lower part having an elongate bottom wall, upwardly extending side walls, and a forward end wall, and an upper part having an elongate top, downwardly extending side walls extending on the side walls of the lower part and a forward end wall on the forward end wall of the lower part;

a slide having a forward and a rearward portion slidable in the slideway between an outer rearward position and a forward position;

means for limiting rearward movement of the slide and determining its rearward position;

the rearward portion of the slide having a relatively deep narrow recess for holding a check on edge therein with the check projecting up out of said check-holding recess, the latter being located outwardly of the rearward end of the body when the slide is in its rearward position and being located within the body when the slide is pushed inward and forward;

spring means biasing the check slide outwardly to its said rearward position;

the body having a hole at one side for insertion of a bar;

and means for latching the slide in its said forward position and latching the inserted bar in said body, the slide being released from said forward position for return to its said rearward position by the bar upon insertion of the bar in said body;

characterized in that said slideway has sides defined by said upwardly extending walls of said lower part and said downwardly extending walls of said upper part and a bottom in said lower part, said lower part being formed with an upwardly opening groove narrower than the slideway in the bottom of the slideway extending lengthwise of the slideway having a rearward end adjacent the rearward end of the body and a forward end spaced from the forward end of the body, said slide having a lug extending down therefrom into said groove slidable with said slide in the groove lengthwise of the groove, and so located along the length of the slideway as to be adjacent the rearward end of the groove when the slide is in its rearward position, said spring means comprising a coil compression spring pocketed in the groove between said lug and said forward end of the groove and reacting from the forward end of the groove against the lug to bias the slide outwardly to its rearward position.

2. Apparatus as set forth in claim 1 further having means for limiting the inward movement of the slide in the absence of a check in the check-holding recess but allowing inward movement of the slide to forward position inward of the limit as long as a check is placed in the check-holding recess.

3. Apparatus as set forth in claim 1 wherein said upper and lower parts are each molded of plastic and wherein said lower part is molded with a groove in the bottom thereof extending from the rearward end to the forward end thereof for receiving the handle of a cart on which the apparatus is to be mounted in position extending lengthwise of the handle.

4. Apparatus as set forth in claim 3 wherein said groove in the bottom of said lower part has a top formation comprising surfaces angled outward and downward from a central peak.

5. Apparatus as set forth in claim 1 wherein said upper and lower parts are each molded of plastic and wherein said lower part is molded with a groove in the bottom thereof extending from one side to the other side thereof for receiving the handle of a cart on which the apparatus is to be mounted in position extending crosswise of the handle.

6. Apparatus as set forth in claim 5 wherein said groove in the bottom of said lower part has a top formation comprising surfaces angled outward and downward from a central peak.

7. Apparatus as set forth in claim 1 wherein said upper and lower parts are each molded of plastic and wherein said lower part is molded with a groove in the bottom thereof extending from the rearward end to the forward end thereof for receiving the handle of a cart on which the apparatus is to be mounted in position extending lengthwise of the handle, and wherein said lower part is also molded with a groove in the bottom thereof extending from one side to the other side thereof for receiving the handle of a cart on which the apparatus is to be mounted in position extending crosswise of the handle.

8. Apparatus as set forth in claim 7 wherein each said groove in the bottom of said lower part has a top formation comprising surfaces angled outward and downward from a central peak.

9. Apparatus as set forth in claim 7 having a clamp for clamping the apparatus on the handle of a cart with the apparatus extending in either of said lengthwise or crosswise positions, means for attaching the clamp to said lower part of the body mating with either of said grooves, and means on the clamp for closing off the groove other than the groove with which it is mated.

10. Apparatus for locking shopping carts together in nested series comprising a mechanism to be mounted on the handle of a cart and which is adapted for receiving and releasably locking therein a bar on a tether attached to the next cart in the series, said mechanism comprising:

a body having a top, bottom, sides and rearward and forward ends, with an elongate slideway for a slide extending therein from the rearward end thereof toward the forward end;

said body being of two-part construction comprising a lower part having an elongate bottom wall, upwardly extending side walls, and a forward end wall, and an upper part having an elongate top, downwardly extending side walls extending on the side walls of the lower part and a forward end wall on the forward end wall of the lower part;

a slide having a forward and a rearward portion slidable in the slideway between an outer rearward position and a forward position;

means for limiting rearward movement of the slide and determining its rearward position;

the rearward portion of the slide having a relatively deep narrow recess for holding a check on edge therein with the check projecting up out of said recess, the latter being located outwardly of the rearward end of the body when the slide is in its rearward position for deposit of a check therein and for retrieval of a check therefrom and being located within the body when the slide is pushed inward and forward;

characterized in that each of said upper and lower parts of the body is molded of plastic and said lower part is molded with a groove in the bottom thereof extending from the rearward end to the forward end thereof for receiving the handle of a cart on which the apparatus is to be mounted in position extending lengthwise of the handle, and wherein said lower part is also molded with a groove in the bottom thereof extending from one side to the other side thereof for receiving the handle of a cart on which the apparatus is to be mounted in position extending crosswise of the handle.

11. Apparatus as set forth in claim 10 having a clamp for clamping the apparatus on the handle of a cart with the apparatus extending in either of said lengthwise or crosswise positions, means for attaching the clamp to said lower part of the body mating with either of said grooves, and means on the clamp for closing off the groove other than the groove with which it is mated.

12. Apparatus for locking shopping carts together in a nested series comprising a mechanism which is mounted on a cart and which is adapted for insertion of and releasably locking therein a bar on a tether attached to the next cart in the series, said mechanism comprising:

a housing for attachment to a cart;

a holder having a recess therein for holding either a check for check-controlled operation of the mechanism or an item serving as a reward for a customer returning the cart to a cart corral and locking the cart so returned to the next cart in the series;

said holder being carried by the housing for movement inward and outward relative to the housing between a first position wherein the recess is accessible outside the housing and a second position wherein the recess is within the housing and inaccessible;

a detent mounted in the housing for movement between a position for limiting the inward movement of said holder and a retracted position allowing inward movement of the holder to its said second position;

spring means biasing the holder outward to its said first position;

the housing having an opening for insertion of a bar;

means for latching the holder in its said second position and latching the inserted bar in said housing, the holder being released from its said second position for return to its said first position by the bar upon insertion of the bar in said housing; and a detent actuator removably associated with the holder for moving the detent to its retracted position allowing inward movement of the holder to its said second position for operation of the apparatus in a mode wherein an item serving as a reward is placed in the recess and the holder moved inward as permitted by movement of the detent to its said retracted position, said detent actuator being removable for operation of the mechanism in an alternative mode of operation wherein a check is placed in the recess for moving the detent to its retracted position to permit inward movement of the holder to its said second position.

13. Apparatus as set forth in claim 12 wherein said housing comprises an elongate body having a top, bottom, sides and rearward and forward ends with an elongate slideway extending therein from the rearward end thereof toward the forward end, said body being adapted for being mounted in a generally horizontal position on a shopping cart;

said holder comprises a slide having a forward and a rearward portion slidable in the slideway between an outer rearward position and a forward position;

the recess is a relatively deep narrow recess in the rearward portion of the slide for holding a check therein with the check projecting up out of said recess, the latter being located outwardly of the rearward end of the body when the slide is in its rearward position for deposit of a check therein and for retrieval of a check therefrom and being located within the body when the slide is pushed inward and forward;

the upper portion of a check in the recess being engageable with the detent when the slide is pushed inward and forward to said forward position to move the detent to its retracted position;

the body has said opening for insertion of a bar at one side thereof;

the latching means acts to latch the slide in its said forward position and to latch the inserted bar in said body, the slide being released for return to its said rearward position by the bar upon insertion of the bar in said body;

said recess is also adapted to hold said item serving as a reward for a customer who returns the cart to a cart corral and locks the bar on the respective tether to the mechanism on the next cart in the series;

said detent actuator is removably carried by the slide adjacent the forward end of the recess in the slide for actuating the detent in said mode of operation wherein a reward is placed in the recess and the slide pushed in to forward position as permitted by retraction of the detent by the detent actuator.

14. Apparatus as set forth in claim 13 wherein said detent actuator comprises a pin removably secured in a tapped hole in the slide extending generally vertically in the slide adjacent the forward end of the recess generally in the vertical plane of the recess, the pin having an upper end projecting up above the top of the slide for engagement with the detent.

15. Apparatus as set forth in claim 14 wherein said tapped hole is a tapped hole extending completely through the slide from top to bottom of the slide, and the pin is threaded in the tapped hole and has a lower end within the hole above the bottom of the hole, the pin being adapted to be turned by a tool inserted in the hole from the lower end of the hole.

16. In the handling of shopping carts by an establishment which provides shopping carts for use by its customers, the method of encouraging the return of the carts by customers to a cart corral after completion of shopping comprising;

providing carts for customer use equipped with a mechanism for locking carts together in a nested series with the carts unlocked for being wheeled away for shopping by customers;

the locking mechanism on each cart being adapted to receive a bar on a tether attached to the next cart in the series and comprising a housing for attachment to a cart, said housing having an opening for insertion of a bar, a holder having a recess therein adapted to hold an item serving as a reward for a customer returning the cart to a cart corral and locking the cart so returned to the next cart in the series, said holder being carried by the housing for movement inward and outward relative to the housing between a first position wherein the recess is accessible outside the housing and a second position wherein the recess is within the housing and inaccessible, means for biasing the holder outwardly to its said first position, and means for latching the holder in its said second position and latching the inserted bar in said housing, the holder being released from its said second position for return to its said first position by the bar upon insertion of the bar in said housing;

maintaining a supply of carts with the locking mechanism of each cart in said supply having its said holder latched in its said second position within said housing;

one or more of the carts in said supply having an item in the recess in the holder of the locking mechanism thereof serving as a reward for the customer using the cart, the holder being released for movement to its said first position presenting the reward to the customer upon return of the cart by the customer to a cart corral and locking of the cart to the next cart of a series in the corral.

17. In the handling of shopping carts by an establishment which provides shopping carts for use by its customers, the method of encouraging the return of the carts by customers to a cart corral after completion of shopping comprising;

providing carts for customer use equipped with a mechanism for locking carts together in a nested series with the carts unlocked for being wheeled away for shopping by customers;

the locking mechanism on each cart being adapted to receive a bar on a tether attached to the next cart in the series and comprising a body having a slideway therein, a slide having a forward and a rearward position with a recess in said rearward portion adapted to hold an item serving as a reward for a customer returning the cart to a cart corral and locking the cart so returned to the next cart in the series, said slide being slidable forward and rearward in the slideway between an outer rearward position wherein the recess is located outwardly of the body and a forward position wherein the recess is within the body, means for biasing the slide outwardly to its said rearward position, and means for latching the slide in its said forward position against the bias and latching the inserted bar in said body;

maintaining a supply of carts with the locking mechanism of each cart in said supply having its slide latched in its said forward position within said body;

one or more of the carts in said supply having an item in the recess in the slide serving as a reward for the customer using the cart, the slide being released for movement to its said rearward position presenting the reward to the customer upon return of the cart by the customer to a cart corral and locking of the cart to the next cart of a series in the corral.

18. Apparatus for locking shopping carts together in nested series comprising a mechanism which is mounted on a cart and which is adapted for receiving and releasably locking therein a bar on a tether attached to the next cart in the series; said mechanism comprising:

an elongate body having a top, bottom sides and rearward and forward ends, with an elongate slideway for a slide extending therein from the rearward end thereof toward the forward end, said body being adapted for being mounted in a generally horizontal position on a shopping cart;

said body being of two-part construction comprising a lower part having an elongate bottom wall, upwardly extending side walls, and a forward end wall, and an upper part having an elongate top, downwardly extending side walls extending on the side walls of the lower part and a forward end wall on the forward end wall of the lower part;

a slide having a forward and a rearward portion slidable in the slideway between an outer rearward position and a forward position;

means for limiting rearward movement of the slide and determining its rearward position;

the rearward portion of the slide having a relatively deep narrow recess for holding a check on edge therein with the check projecting up out of said check-holding recess, the latter being located outwardly of the rearward end of the body when the slide is in its rearward position and being located within the body when the slide is pushed inward and forward;

spring means biasing the check slide outwardly to its said rearward position;

the body having a hole at one side for insertion of a bar;

and means for latching the slide in its said forward position and latching the inserted bar in said body, the slide being released from said forward position for return to its said rearward position by the bar upon insertion of the bar in said body;

characterized in that said slideway has sides defined by said upwardly extending walls of said lower part and said downwardly extending walls of said upper part and a bottom in said lower part, said lower part being formed with a groove in the bottom part underneath the slideway, said groove opening upwardly to the slideway extending lengthwise of the slideway and having a rearward end located toward the rearward end of the body and a forward end located forward of the rearward end, said slide having a lug extending down therefrom into said groove slidable with the slide lengthwise of the groove, said lug being so located along the length of the slideway as to be in a rearward position toward the rearward end of the groove when the slide is in its rearward position and in a forward lug position forward of said rearward lug position when the slide is in its forward position, and a spring pocketed in said groove between one of said ends thereof and the lug acting on the lug to bias the slide rearwardly outwardly to said rearward slide position.

* * * * *